US006971211B1

(12) United States Patent
Zehner

(10) Patent No.: US 6,971,211 B1
(45) Date of Patent: Dec. 6, 2005

(54) CELLULOSIC/POLYMER COMPOSITE MATERIAL

(75) Inventor: Burch E. Zehner, Gahanna, OH (US)

(73) Assignee: Crane Plastics Company LLC, Columbus, OH (US)

( * ) Notice: Subject to any disclaimer, the term of this patent is extended or adjusted under 35 U.S.C. 154(b) by 0 days.

(21) Appl. No.: 10/802,467

(22) Filed: Mar. 17, 2004

Related U.S. Application Data

(63) Continuation of application No. 09/576,706, filed on May 22, 2000, now abandoned.

(60) Provisional application No. 60/135,443, filed on May 22, 1999.

(51) Int. Cl.[7] ..... E04C 2/10; E04C 2/20

(52) U.S. Cl. ..... 52/518; 428/516; 428/532; 521/84.1; 521/143; 521/144; 521/145; 524/13; 524/14; 524/35

(58) Field of Search ... 521/84.1, 143–145; 524/13–14, 524/35; 428/516, 532; 52/518

(56) References Cited

U.S. PATENT DOCUMENTS

| | | | | |
|---|---|---|---|---|
| 2,188,396 A | | 1/1940 | Semon | 18/55 |
| 2,489,373 A | | 11/1949 | Gilman | 260/37 |
| 2,519,442 A | | 8/1950 | Delorme et al. | 260/37 |
| 2,558,378 A | | 6/1951 | Petry | 260/41 |
| 2,635,976 A | | 4/1953 | Meiler et al. | 154/132 |
| 2,680,102 A | | 6/1954 | Becher | 260/17.3 |
| 2,789,903 A | | 4/1957 | Lukman et al. | 92/21 |
| 2,935,763 A | | 5/1960 | Newman et al. | 18/55 |
| 3,287,480 A | | 11/1966 | Wechsler et al. | 264/122 |
| 3,308,218 A | | 3/1967 | Wiegand et al. | 264/121 |
| 3,309,444 A | | 3/1967 | Schueler | 264/109 |
| 3,492,388 A | | 1/1970 | Inglin-Knüsel | 264/129 |
| 3,493,527 A | | 2/1970 | Schueler | 260/17.2 |
| 3,562,373 A | | 2/1971 | Logrippo | 264/118 |
| 3,645,939 A | | 2/1972 | Gaylord | 260/17.4 GC |
| 3,671,615 A | | 6/1972 | Price | 264/39 |
| 3,864,201 A | | 2/1975 | Susuki et al. | 161/160 |
| 3,867,493 A | | 2/1975 | Seki | 264/45.9 |
| 3,878,143 A | | 4/1975 | Baumann et al. | 260/17.4 R |
| 3,879,505 A | | 4/1975 | Boutillier et al. | 264/48 |
| 3,888,810 A | | 6/1975 | Shinomura | 260/17.4 BB |
| 3,899,559 A | | 8/1975 | Johnanson et al. | 264/115 |
| 3,908,902 A | | 9/1975 | Collins et al. | 238/83 |
| 3,922,328 A | | 11/1975 | Johnson | 264/46.1 |
| 3,931,384 A | | 1/1976 | Forquer et al. | 264/120 |
| 3,943,079 A | | 3/1976 | Hamed | 260/17.4 BB |
| 3,954,555 A | | 5/1976 | Kole et al. | 162/136 |
| 3,956,541 A | | 5/1976 | Pringle | 428/2 |
| 3,956,555 A | | 5/1976 | McKean | 428/106 |
| 3,969,459 A | | 7/1976 | Fremont et al. | 264/109 |
| 4,005,162 A | | 1/1977 | Bucking | 264/25 |
| 4,012,348 A | | 3/1977 | Chelland et al. | 260/28.5 R |
| 4,016,232 A | | 4/1977 | Pringle | 264/112 |
| 4,016,233 A | | 4/1977 | Pringle | 264/122 |
| 4,018,722 A | | 4/1977 | Baker | 260/2.3 |
| 4,029,831 A | | 6/1977 | Daunheimer | 427/264 |
| 4,045,603 A | | 8/1977 | Smith | 428/2 |
| 4,056,591 A | | 11/1977 | Goettler et al. | 264/108 |
| 4,058,580 A | | 11/1977 | Flanders | 264/113 |
| 4,071,479 A | | 1/1978 | Broyde et al. | 260/2.3 |
| 4,071,494 A | | 1/1978 | Gaylord | 260/42.14 |
| 4,081,582 A | | 3/1978 | Butterworth et al. | 428/284 |
| 4,097,648 A | | 6/1978 | Pringle | 428/326 |
| 4,102,106 A | * | 7/1978 | Golder et al. | 52/533 |
| 4,107,110 A | | 8/1978 | Lachowicz et al. | 260/17.4 CL |
| 4,115,497 A | | 9/1978 | Halmø et al. | 264/115 |
| 4,129,132 A | | 12/1978 | Butterworth et al. | 604/366 |
| 4,145,389 A | | 3/1979 | Smith | 264/40.7 |
| 4,157,415 A | | 6/1979 | Lindenberg | 428/284 |
| 4,168,251 A | * | 9/1979 | Schinzel et al. | 524/14 |
| 4,178,411 A | | 12/1979 | Cole et al. | 428/310 |
| 4,181,764 A | | 1/1980 | Totten | 428/155 |
| 4,187,352 A | | 2/1980 | Klobbie | 521/79 |
| 4,191,798 A | | 3/1980 | Schumacher et al. | 428/95 |
| 4,203,876 A | | 5/1980 | Dereppe et al. | 260/17.4 R |
| 4,228,116 A | | 10/1980 | Colombo et al. | 264/119 |
| 4,239,679 A | | 12/1980 | Rolls et al. | 260/42.49 |
| 4,241,125 A | | 12/1980 | Canning et al. | 428/158 |
| 4,241,133 A | | 12/1980 | Lund et al. | 428/326 |
| 4,244,903 A | | 1/1981 | Schnause | 264/68 |

(Continued)

FOREIGN PATENT DOCUMENTS

| | | |
|---|---|---|
| EP | 0668142 | 8/1995 |

(Continued)

*Primary Examiner*—Peter Szekely
(74) *Attorney, Agent, or Firm*—Standley Law Group LLP

(57) ABSTRACT

The present invention is a component such as a siding panel that may be comprised of various formulations of cellulosic/polymer composite materials. One embodiment of the present invention is a siding panel that is comprised of a cellulosic/PVC composite material. This composite material may include at least one cellulosic filler in the amount of about 30% to about 60% by weight and a PVC material in the amount of about 40% to about 70% by weight. The PVC material may include about 1 to about 10 parts stabilizer(s) per 100 parts of the PVC resin, about 2 to about 12 parts lubricant(s) per 100 parts of the PVC resin, and about 0.5 to about 8 parts process aid(s) per 100 parts of the PVC resin. Another embodiment of the present invention is a siding panel that may be comprised of a cellulosic/polypropylene composite material. This composite material is comprised of at least one cellulosic filler in an amount of about 30% to about 70% by weight and a polypropylene material in an amount of about 30% to about 70% by weight. The polypropylene material includes at least one lubricant in an amount of about 10 to about 20 parts per 100 parts of a polypropylene resin.

26 Claims, 4 Drawing Sheets

U.S. PATENT DOCUMENTS

| | | | | | |
|---|---|---|---|---|---|
| 4,248,743 | A | | 2/1981 | Goettler | 260/17.44 BB |
| 4,248,820 | A | | 2/1981 | Haataja | 264/113 |
| 4,250,222 | A | | 2/1981 | Mavel et al. | 428/285 |
| 4,263,184 | A | | 4/1981 | Leo et al. | 260/17.4 CL |
| 4,263,196 | A | | 4/1981 | Schumacher et al. | 260/33.6 |
| 4,272,577 | A | | 6/1981 | Lyng | 428/112 |
| 4,273,688 | A | | 6/1981 | Porzel et al. | 260/17.4 R |
| 4,277,428 | A | | 7/1981 | Luck et al. | 264/118 |
| 4,290,988 | A | | 9/1981 | Nopper et al. | 264/112 |
| 4,297,408 | A | | 10/1981 | Stead et al. | 428/240 |
| 4,303,019 | A | | 12/1981 | Haataja et al. | 108/51.1 |
| 4,305,901 | A | | 12/1981 | Prince et al. | 264/176 R |
| 4,317,765 | A | | 3/1982 | Gaylord | 523/204 |
| 4,323,625 | A | | 4/1982 | Coran et al. | 428/361 |
| 4,351,873 | A | | 9/1982 | Davis | 428/198 |
| 4,376,144 | A | | 3/1983 | Goettler | 428/36 |
| 4,382,108 | A | | 5/1983 | Carroll et al. | 428/326 |
| 4,382,758 | A | | 5/1983 | Nopper et al. | 425/82.1 |
| 4,393,020 | A | | 7/1983 | Li et al. | 264/108 |
| 4,414,267 | A | | 11/1983 | Coran et al. | 428/288 |
| 4,420,351 | A | | 12/1983 | Lussi et al. | 156/62.4 |
| 4,430,468 | A | | 2/1984 | Schumacher | 524/109 |
| 4,440,708 | A | | 4/1984 | Haataja et al. | 264/109 |
| 4,480,061 | A | | 10/1984 | Coughlin et al. | 524/13 |
| 4,481,701 | A | | 11/1984 | Hewitt | 29/416 |
| 4,491,553 | A | | 1/1985 | Yamada et al. | 264/51 |
| 4,503,115 | A | | 3/1985 | Hemels et al. | 428/281 |
| 4,505,869 | A | | 3/1985 | Nishibori | 264/115 |
| 4,506,037 | A | | 3/1985 | Suzuki et al. | 521/82 |
| 4,508,595 | A | | 4/1985 | Gåsland | 162/158 |
| 4,562,218 | A | | 12/1985 | Fornadel et al. | 524/15 |
| 4,594,372 | A | | 6/1986 | Natov et al. | 523/208 |
| 4,597,928 | A | | 7/1986 | Terentiev et al. | 264/87 |
| 4,610,900 | A | | 9/1986 | Nishibori | 428/15 |
| 4,645,631 | A | | 2/1987 | Hegenstaller et al. | 264/69 |
| 4,659,754 | A | | 4/1987 | Edwards et al. | 523/214 |
| 4,663,225 | A | | 5/1987 | Farley et al. | 428/290 |
| 4,687,793 | A | | 8/1987 | Motegi et al. | 523/220 |
| 4,717,742 | A | * | 1/1988 | Beshay | 523/203 |
| 4,734,236 | A | | 3/1988 | Davis | 264/112 |
| 4,737,532 | A | | 4/1988 | Fujita et al. | 524/13 |
| 4,746,688 | A | * | 5/1988 | Bistak et al. | 523/220 |
| 4,769,109 | A | | 9/1988 | Tellvik et al. | 162/123 |
| 4,769,274 | A | | 9/1988 | Tellvik et al. | 428/218 |
| 4,783,493 | A | | 11/1988 | Motegi et al. | 524/13 |
| 4,789,604 | A | | 12/1988 | van der Hoeven | 428/503 |
| 4,790,966 | A | | 12/1988 | Sandberg et al. | 264/39 |
| 4,791,020 | A | | 12/1988 | Kokta | 428/326 |
| 4,800,214 | A | | 1/1989 | Waki et al. | 521/84.1 |
| 4,801,495 | A | | 1/1989 | van der Hoeven | 428/286 |
| 4,818,590 | A | | 4/1989 | Prince et al. | 428/213 |
| 4,818,604 | A | | 4/1989 | Tock | 428/319.9 |
| 4,820,749 | A | | 4/1989 | Beshay | 523/203 |
| 4,851,458 | A | | 7/1989 | Hopperdietzel | 523/205 |
| 4,865,788 | A | | 9/1989 | Davis | 264/112 |
| 4,889,673 | A | | 12/1989 | Takimoto | 264/118 |
| 4,894,192 | A | | 1/1990 | Warych | 264/68 |
| 4,915,764 | A | | 4/1990 | Miani | 156/244.19 |
| 4,927,572 | A | | 5/1990 | van der Hoeven | 264/22 |
| 4,927,579 | A | | 5/1990 | Moore | 264/101 |
| 4,935,182 | A | | 6/1990 | Ehner et al. | 264/112 |
| 4,960,548 | A | | 10/1990 | Ikeda et al. | 264/40.4 |
| 4,968,463 | A | | 11/1990 | Levasseur | 264/40.1 |
| 4,973,440 | A | | 11/1990 | Tamura et al. | 264/114 |
| 4,978,489 | A | | 12/1990 | Radvan et al. | 264/118 |
| 4,988,478 | A | | 1/1991 | Held | 264/518 |
| 5,002,713 | A | | 3/1991 | Palardy et al. | 264/109 |
| 5,008,310 | A | | 4/1991 | Beshay | 524/13 |
| 5,009,586 | A | | 4/1991 | Pallmann | 425/311 |
| 5,049,334 | A | | 9/1991 | Bach | 264/122 |
| 5,057,167 | A | | 10/1991 | Gersbeck | 156/62.2 |
| 5,064,592 | A | | 11/1991 | Ueda et al. | 264/112 |
| 5,075,057 | A | | 12/1991 | Hoedl | 264/115 |
| 5,075,359 | A | | 12/1991 | Castagna et al. | 524/13 |
| 5,078,937 | A | | 1/1992 | Eela | 264/109 |
| 5,082,605 | A | | 1/1992 | Brooks et al. | 264/40.6 |
| 5,087,400 | A | | 2/1992 | Theuveny | 264/115 |
| 5,088,910 | A | | 2/1992 | Goforth et al. | 425/142 |
| 5,091,436 | A | | 2/1992 | Frisch et al. | 521/137 |
| 5,096,046 | A | | 3/1992 | Goforth et al. | 198/604 |
| 5,096,406 | A | | 3/1992 | Brooks et al. | 425/205 |
| 5,110,663 | A | | 5/1992 | Nishiyama et al. | 428/195 |
| 5,110,843 | A | | 5/1992 | Bries et al. | 521/159 |
| 5,120,776 | A | | 6/1992 | Raj et al. | 524/13 |
| 5,153,241 | A | | 10/1992 | Beshay | 524/8 |
| 5,160,784 | A | | 11/1992 | Shmidt et al. | 425/316.6 |
| 5,194,461 | A | | 3/1993 | Bergquist et al. | 524/13 |
| 5,218,807 | A | | 6/1993 | Fulford | 52/455 |
| 5,219,634 | A | | 6/1993 | Aufderhaar | 428/156 |
| 5,272,000 | A | | 12/1993 | Chenoweth et al. | 428/283 |
| 5,276,082 | A | | 1/1994 | Forry et al. | 524/504 |
| 5,284,710 | A | | 2/1994 | Hartley et al. | 428/421 |
| 5,288,772 | A | | 2/1994 | Hon | 524/35 |
| 5,302,634 | A | | 4/1994 | Mushovic | 523/219 |
| 5,356,697 | A | | 10/1994 | Jonas | 428/77 |
| 5,369,147 | A | | 11/1994 | Mushovic | 523/219 |
| 5,393,536 | A | | 2/1995 | Brandt et al. | 425/112 |
| 5,406,768 | A | | 4/1995 | Giuseppe et al. | 52/730.4 |
| 5,422,170 | A | | 6/1995 | Iwata et al. | 428/218 |
| 5,435,954 | A | | 7/1995 | Wold | 264/115 |
| 5,441,801 | A | | 8/1995 | Deaner et al. | 428/326 |
| 5,458,834 | A | | 10/1995 | Faber et al. | 264/109 |
| 5,474,722 | A | | 12/1995 | Woodhams | 264/45.3 |
| 5,480,602 | A | | 1/1996 | Nagaich | 264/122 |
| 5,486,553 | A | | 1/1996 | Deaner et al. | 524/13 |
| 5,497,594 | A | | 3/1996 | Giuseppe et al. | 52/730.4 |
| 5,516,472 | A | * | 5/1996 | Laver | 264/118 |
| 5,518,677 | A | | 5/1996 | Deaner et al. | 264/142 |
| 5,532,065 | A | | 7/1996 | Gübitz et al. | 428/480 |
| 5,537,789 | A | | 7/1996 | Minke et al. | 52/313 |
| 5,539,027 | A | | 7/1996 | Deaner et al. | 524/13 |
| 5,574,094 | A | | 11/1996 | Malucelli et al. | 525/54.3 |
| 5,576,374 | A | | 11/1996 | Betso et al. | 524/451 |
| 5,585,155 | A | | 12/1996 | Heikkila et al. | 428/36 |
| 5,593,625 | A | | 1/1997 | Riebel et al. | 264/115 |
| 5,695,874 | A | | 12/1997 | Deaner et al. | 428/326 |
| 5,725,939 | A | | 3/1998 | Nishibori | 428/292 |
| 5,735,092 | A | | 4/1998 | Clayton et al. | 52/309.9 |
| 5,759,680 | A | | 6/1998 | Brooks et al. | 428/326 |
| 5,773,138 | A | | 6/1998 | Seethamraju et al. | 428/326 |
| 5,776,841 | A | | 7/1998 | Bondoc et al. | 442/320 |
| 5,783,125 | A | | 7/1998 | Bastone et al. | 264/45.3 |
| 5,795,641 | A | | 8/1998 | Pauley et al. | 428/134 |
| 5,807,514 | A | | 9/1998 | Grinshpun et al. | 264/46.6 |
| 5,827,462 | A | | 10/1998 | Brandt et al. | 264/179 |
| 5,827,607 | A | | 10/1998 | Deaner et al. | 428/326 |
| 5,836,128 | A | | 11/1998 | Groh et al. | 52/580 |
| 5,847,016 | A | * | 12/1998 | Cope | 521/84.1 |
| 5,863,064 | A | | 1/1999 | Rheinlander et al. | 280/732 |
| 5,866,264 | A | | 2/1999 | Zehner et al. | 428/481 |
| 5,882,564 | A | | 3/1999 | Puppin | 264/177.16 |
| 5,910,358 | A | | 6/1999 | Thoen et al. | 428/316.6 |
| 5,932,334 | A | | 8/1999 | Deaner et al. | 428/292.4 |
| 5,948,505 | A | | 9/1999 | Puppin | 428/121 |
| 5,948,524 | A | | 9/1999 | Seethamraju et al. | 428/326 |
| 5,951,927 | A | * | 9/1999 | Cope | 264/54 |
| 5,965,075 | A | | 10/1999 | Pauley et al. | 264/176.1 |
| 5,981,067 | A | | 11/1999 | Seethamraju et al. | 428/393 |
| 5,985,429 | A | | 11/1999 | Plummer et al. | 428/220 |
| 6,004,652 | A | | 12/1999 | Clark | 428/133 |
| 6,004,668 | A | | 12/1999 | Deaner et al. | 428/326 |
| 6,007,656 | A | | 12/1999 | Heikkila et al. | 156/180 |
| 6,011,091 | A | | 1/2000 | Zehner | 524/13 |
| 6,015,611 | A | | 1/2000 | Deaner et al. | 428/326 |

| | | | | |
|---|---|---|---|---|
| 6,015,612 | A | 1/2000 | Deaner et al. | 428/326 |
| 6,035,588 | A | 3/2000 | Zehner et al. | 52/98 |
| 6,044,604 | A | 4/2000 | Clayton et al. | 52/309.9 |
| 6,054,207 | A | 4/2000 | Finley | 428/317.9 |
| 6,066,680 | A * | 5/2000 | Cope | 521/79 |
| 6,103,791 | A | 8/2000 | Zehner | 524/13 |
| 6,106,944 | A | 8/2000 | Heikkila et al. | 428/397 |
| 6,114,008 | A | 9/2000 | Eby et al. | 428/151 |
| 6,117,924 | A | 9/2000 | Brandt | 524/13 |
| 6,122,877 | A * | 9/2000 | Hendrickson et al. | 52/520 |
| 6,131,355 | A | 10/2000 | Groh et al. | 52/592.1 |
| 6,133,348 | A | 10/2000 | Kolla et al. | 524/9 |
| 6,153,293 | A | 11/2000 | Dahl et al. | 428/310.5 |
| 6,180,257 | B1 | 1/2001 | Brandt et al. | 428/532 |
| 6,210,616 | B1 | 4/2001 | Suwanda | 264/151 |
| 6,210,792 | B1 | 4/2001 | Seethamraju et al. | 428/326 |
| 6,248,813 | B1 | 6/2001 | Zehner | 524/13 |
| 6,265,037 | B1 * | 7/2001 | Godavarti et al. | 428/34 |
| 6,272,808 | B1 | 8/2001 | Groh et al. | 52/592.1 |
| 6,280,667 | B1 | 8/2001 | Koenig et al. | 264/68 |
| 6,284,098 | B1 | 9/2001 | Jacobsen | 162/150 |
| 6,295,777 | B1 * | 10/2001 | Hunter et al. | 52/519 |
| 6,295,778 | B1 | 10/2001 | Burt | 52/592.6 |
| 6,337,138 | B1 | 1/2002 | Zehner et al. | 428/511 |
| 6,342,172 | B1 | 1/2002 | Finley | 264/45.3 |
| 6,344,268 | B1 | 2/2002 | Stucky et al. | 428/317.9 |
| 6,344,504 | B1 | 2/2002 | Zehner et al. | 524/14 |
| 6,346,160 | B1 | 2/2002 | Puppin | 156/88 |
| 6,357,197 | B1 | 3/2002 | Serino et al. | 52/738.1 |
| 6,358,585 | B1 | 3/2002 | Wolff | 428/36.6 |
| 6,362,252 | B1 | 3/2002 | Prutkin | 523/200 |
| 6,409,952 | B1 | 6/2002 | Hacker et al. | 264/171.1 |
| 6,464,913 | B1 | 10/2002 | Korney, Jr. | 264/102 |
| 6,498,205 | B1 | 12/2002 | Zehner | 524/14 |
| 6,511,757 | B1 | 1/2003 | Brandt et al. | 428/532 |
| 6,531,010 | B2 | 3/2003 | Puppin | 156/88 |
| 6,590,004 | B1 | 7/2003 | Zehner | 521/84.1 |
| 6,605,245 | B1 * | 8/2003 | Dubelsten et al. | 264/446 |
| 6,682,789 | B2 | 1/2004 | Godavarti et al. | 428/34 |
| 6,682,814 | B2 | 1/2004 | Hendrickson et al. | 428/326 |
| 6,685,858 | B2 | 2/2004 | Korney, Jr. | 264/102 |
| 2001/0051242 | A1 | 12/2001 | Godavarti et al. | 428/36.9 |
| 2001/0051243 | A1 | 12/2001 | Godavarti et al. | 428/36.9 |
| 2002/0015820 | A1 | 2/2002 | Puppin | 428/121 |
| 2002/0092256 | A1 | 7/2002 | Hendrickson et al. | 52/519 |

FOREIGN PATENT DOCUMENTS

| | | |
|---|---|---|
| WO | WO 99/11444 | 3/1999 |
| WO | WO 00/11282 | 3/2000 |
| WO | WO 00/34017 | 6/2000 |
| WO | WO 00/39207 | 7/2000 |

* cited by examiner

CELLULOSIC/POLYMER COMPOSITE MATERIAL

This application is a continuation of U.S. application Ser. No. 09/576,706, filed May 22, 2000, now abandoned, which claims the benefit of U.S. Provisional Application No. 60/135,443, filed May 22, 1999. The entirety of each of these applications is hereby incorporated by reference.

BACKGROUND AND SUMMARY OF THE INVENTION

The present invention relates generally to wood replacement materials, and more particularly, to cellulosic/polymer composite materials. The present invention will be described primarily with reference to wood flour/polyvinyl chloride (PVC) composites and wood flour/polypropylene composites. However, the present invention includes several different formulations and material composites including, but not limited to, PVC formulations and polypropylene formulations that include an inorganic filler in addition to the cellulosic material.

The supply of natural woods for construction and other purposes is dwindling. As a result, many are concerned about conserving the world's forests, and the cost of natural woods has risen. In light of these factors, a tremendous demand has developed in recent years for cellulosic/polymer composites that exhibit the look and feel of natural woods.

Cellulosic/polymer composites are used as replacements for all-natural wood, particle board, wafer board, and other similar materials. For example, U.S. Pat. Nos. 3,908,902, 4,091,153, 4,686,251, 4,708,623, 5,002,713, 5,055,247, 5,087,400, and 5,151,238 relate to processes for making wood replacement products. As compared to natural woods, cellulosic/polymer composites offer superior resistance to wear and tear. In particular, cellulosic/polymer composites have enhanced resistance to moisture. In fact, it is well known that the retention of moisture is a primary cause of the warping, splintering, and discoloration of natural woods. Moreover, cellulosic/polymer composites may be sawed, sanded, shaped, turned, fastened, and finished in the same manner as natural woods. Therefore, cellulosic/polymer composites are commonly used for applications such as interior and exterior decorative house moldings, picture frames, furniture, porch decks, deck railings, window moldings, window components, door components, roofing structures, building siding, and other suitable indoor and outdoor items.

The present invention provides cellulosic/polymer composite materials that can be produced in a commercially reasonable environment. One example of the present invention is a cellulosic/PVC composite, and another example of the present invention is a cellulosic/polypropylene composite. The cellulosic/polymer compositions of the present invention can be processed and shaped into resultant products having desired appearance, strength, durability, and weatherability. In addition, the present invention provides improved methods of making such cellulosic/polymer composites.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

The present invention is directed to cellulosic/polymer composite materials. The present invention also includes methods of manufacturing cellulosic/polymer composite materials. The cellulosic/polymer composite materials of the present invention can be used as a substitute for natural wood, particle board, wafer board, and other similar materials. For example, the composites of the present invention can be used to make interior and exterior decorative house moldings, picture frames, furniture, porch decks, deck railings, window moldings, window components, door components, roofing structures, building siding, and other suitable indoor and outdoor items.

Figure 1:
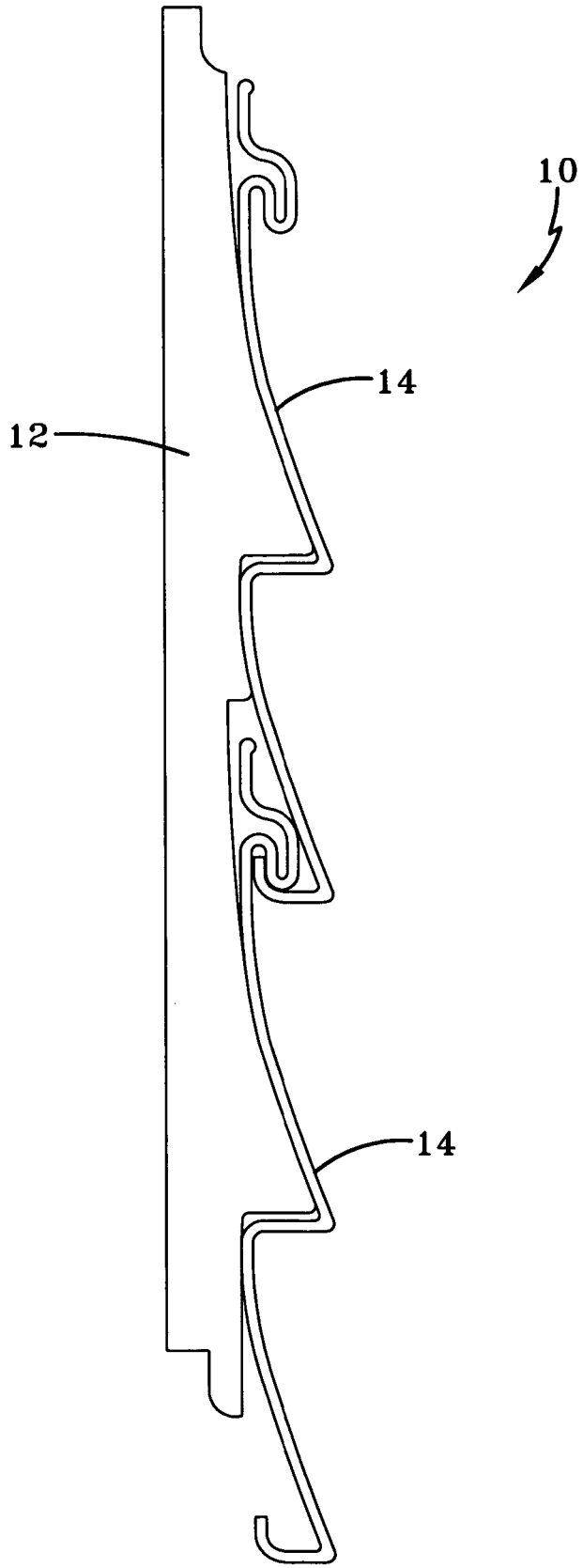
FIG. 1 is a side elevation view of an exemplary embodiment of a siding unit made with a cellulosic/polymer composite of the present invention.
Figure 2:
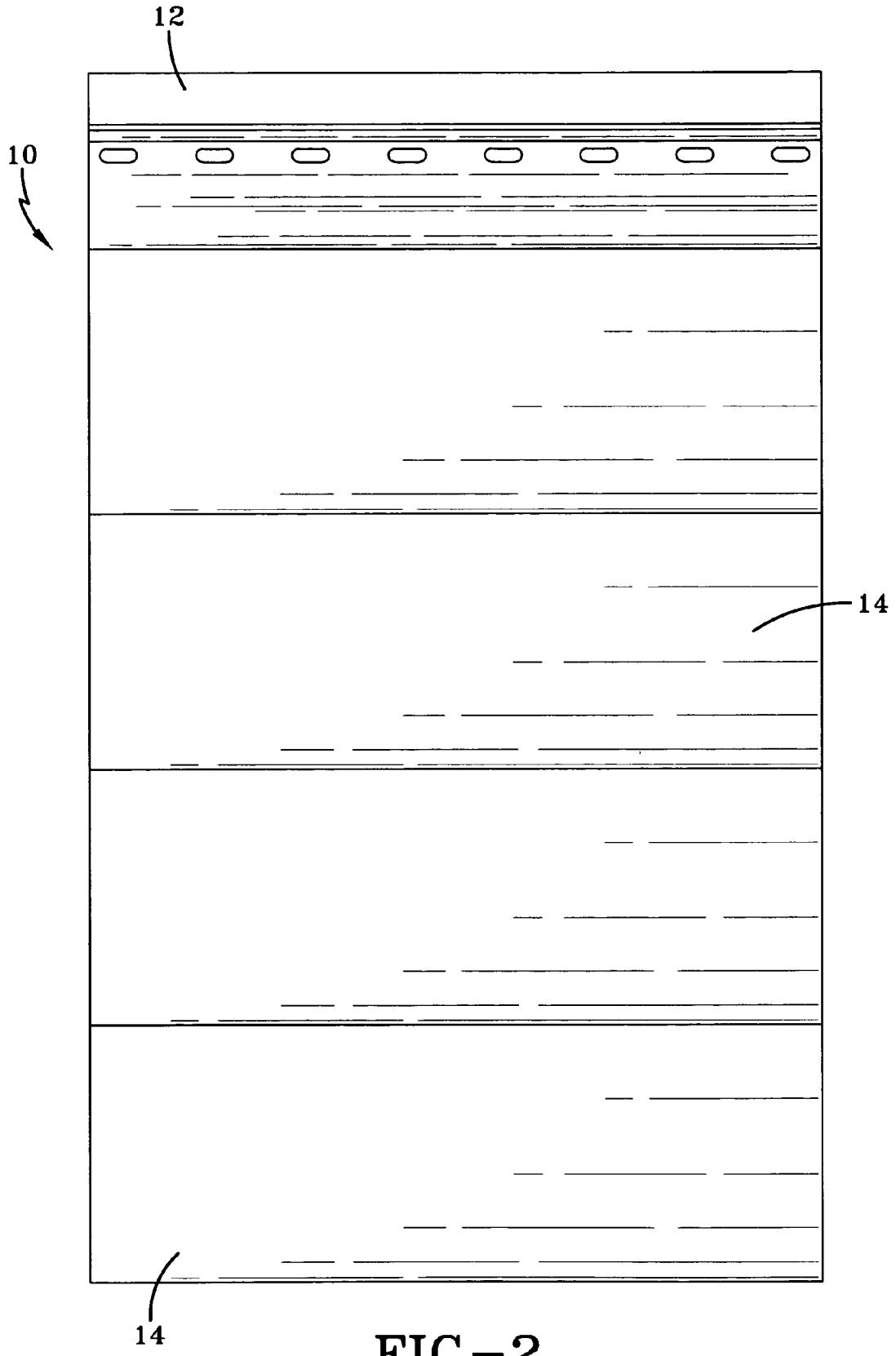
FIG. 2 is an exterior plan view of the siding unit of FIG. 1.
Figure 3:
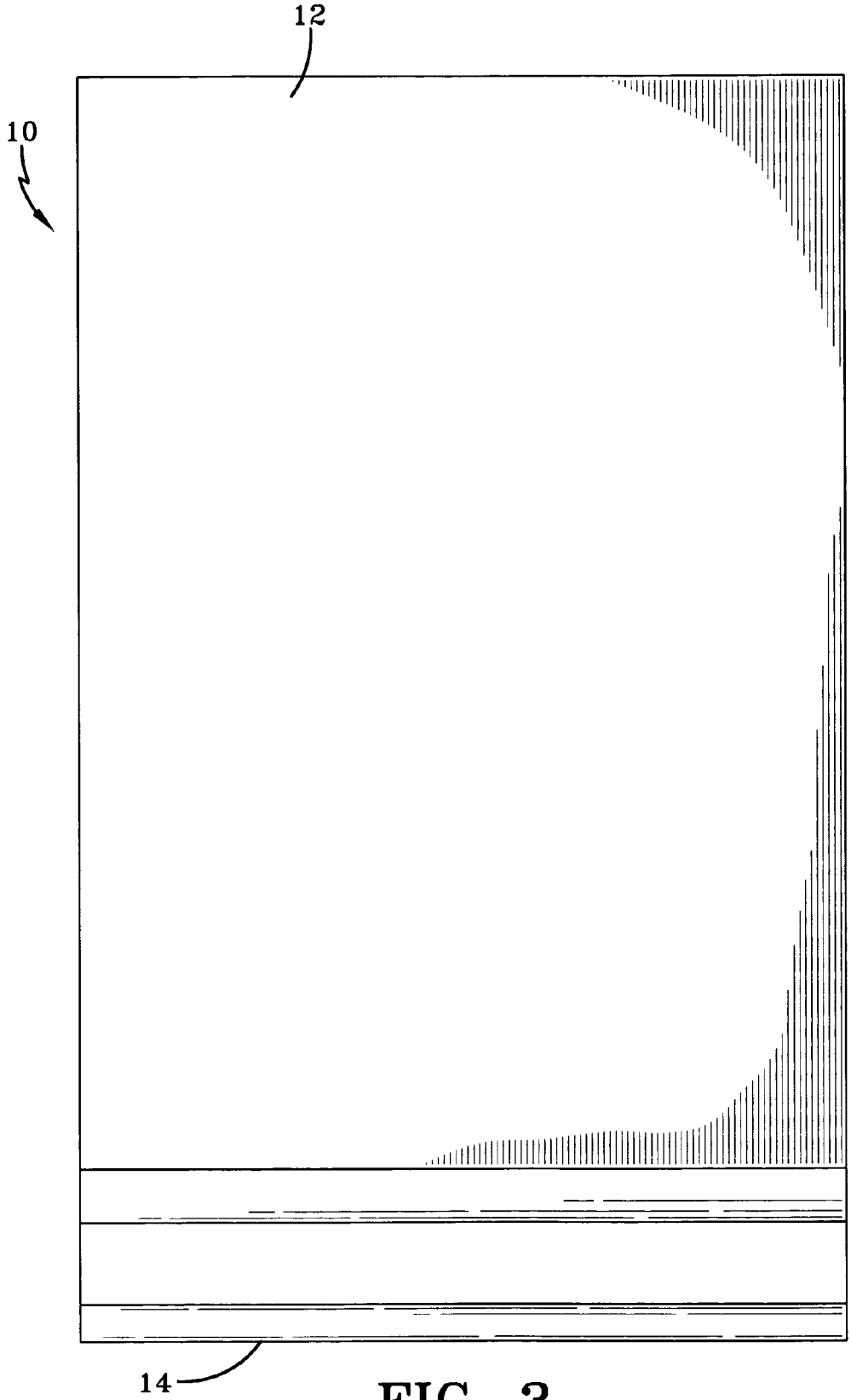
FIG. 3 is an interior plan view of the siding unit of FIG. 1.
Figure 4:
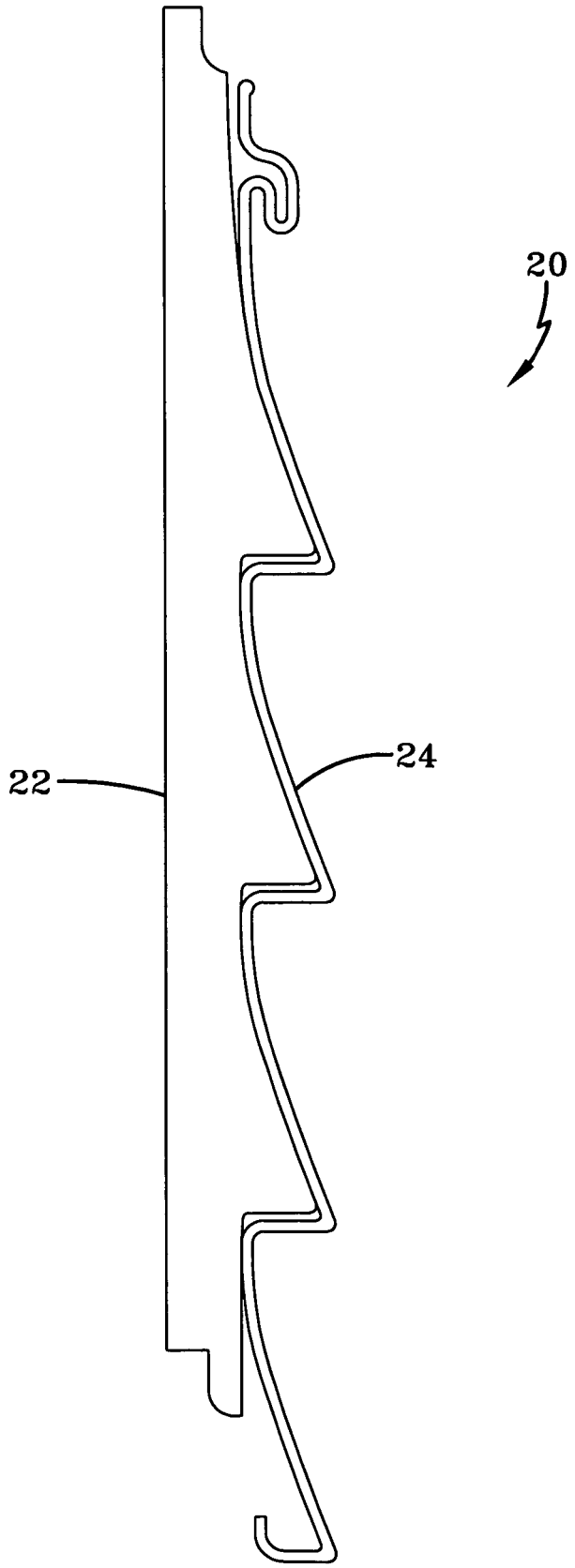
FIG. 4 is a side elevation view of another exemplary embodiment of a siding unit made with a cellulosic/polymer composite of the present invention.

FIGS. 1 through 3 show an example of a siding unit 10 that can be made with a composite of the present invention. FIG. 4 shows another example of a siding unit 20 that can be made with a composite of the present invention. It shall be understood that the siding units may be comprised of any desired number of rows or courses. As shown in FIGS. 1 through 4, at least one backer 12, 22 may optionally be secured to the inside of at least one respective facing panel 14, 24. A backer may be comprised of a sufficiently rigid, insulating material such as expanded or extruded polystyrene foam, fiberglass, cardboard, a fire retardant grade of polyurethane foam, or any other suitable, conventional, or similar material.

The materials that may be used to make the composites of the present invention include, but are not limited to, cellulosic fillers, polymers, inorganic fillers, cross-linking agents, lubricants, process aids, stabilizers, accelerators, inhibitors, enhancers, compatibilizers, blowing agents, foaming agents, thermosetting materials, and other suitable materials. Examples of cellulosic fillers include sawdust, newspapers, alfalfa, wheat pulp, wood chips, wood fibers, wood particles, ground wood, wood flour, wood flakes, wood veneers, wood laminates, paper, cardboard, straw, cotton, rice hulls, coconut shells, peanut shells, bagass, plant fibers, bamboo fiber, palm fiber, kenaf, and other similar materials. Examples of polymers include multilayer films, high density polyethylene (HDPE), polypropylene, PVC, low density polyethylene (LDPE), chlorinated polyvinyl chloride (CPVC), acrylonitrile butadiene styrene (ABS), ethyl-vinyl acetate, other similar copolymers, other similar, suitable, or conventional thermoplastic materials, and formulations that incorporate any of the aforementioned polymers. Examples of inorganic fillers include talc, calcium carbonate, kaolin clay, magnesium oxide, titanium dioxide, silica, mica, barium sulfate, and other similar, suitable, or conventional materials. Examples of cross-linking agents include polyurethanes, such as isocyanates, phenolic resins, unsaturated polyesters, epoxy resins, and other similar, suitable, or conventional materials. Combinations of the aforementioned materials are also examples of cross-linking agents. Examples of lubricants include zinc stearate, calcium stearate, esters, amide wax, paraffin wax, ethylene bis-stearamide, and other similar, suitable, or conventional materials. Examples of stabilizers include tin stabilizers, lead and metal soaps such as barium, cadmium, and zinc, and other similar, suitable, or conventional materials. In addition, examples of process aids include acrylic modifiers and other similar, suitable, or conventional materials.

One embodiment of the present invention is a cellulosic/PVC composite material. The composite material may include at least one cellulosic filler in the amount of about 30% to about 60% by weight, more preferably about 40% to about 50% by weight, and still more preferably about 48% to about 50% by weight. The composite may also include a PVC material in the amount of about 40% to about 70% by weight, more preferably about 50% to about 60% by weight, and still more preferably about 50% to about 52% by weight.

The cellulosic filler(s) may be dried to a desired moisture content. For example, the cellulosic filler(s) may be dried to about 0.5% to about 3% moisture content by weight, more preferably to about 1% to about 2% moisture content by weight. However, it is appreciated that the cellulosic filler(s) may have a moisture content less than about 0.5% by weight or greater than about 3% by weight.

The PVC material can be made by mixing a PVC resin, at least one stabilizer, at least one lubricant, at least one process aid, and optional other ingredients in a mixer. An example of a mixer is a high intensity mixer such as those made by Littleford Day Inc. or Henschel Mixers America Inc. As an example, the mechanically induced friction may heat the ingredients to a temperature between about 200° F. and about 230° F. After mixing, the ingredients may be cooled to ambient temperature.

The PVC material may include stabilizer(s) in an amount of about 1 to about 10 parts, more preferably about 3 to about 5 parts, per 100 parts of the PVC resin. The lubricant(s) may be present in an amount of about 2 to about 12 parts, more preferably about 4 to about 8 parts, per 100 parts of the PVC resin. Also, process aid(s) may be included in an amount of about 0.5 to about 8 parts, more preferably about 1 to about 3 parts, per 100 parts of the PVC resin. Optionally, at least one inorganic filler may be added in an amount of up to about 10 parts, more preferably up to about 5 parts, per 100 parts of the PVC resin.

The PVC resin may have any desired inherent viscosity. The inherent viscosity is preferably between about 0.6 and 1.1 and more preferably between about 0.7 and 0.9. Nevertheless, it is appreciated that the inherent viscosity of the PVC resin may be less than 0.6 or greater than 1.1.

The cellulosic filler(s) and the PVC material may be mixed together prior to being further processed such as by extrusion or molding. For example, a low intensity mixer may be used to mix the cellulosic filler(s) and the PVC material. An example of a low intensity mixer is a ribbon blender.

The composite material may be processed in an extruder, a compression molding apparatus, or any other suitable, similar, or conventional apparatus. An example of an extruder is a conical, twin screw, counter-rotating extruder with a vent. A force feed hopper or crammer or any other suitable, similar, or conventional apparatus may be used to feed the materials into the extruder. The composite material may be extruded through a die system. The die system may have a compaction ratio between about 2:1 and 4:1. The die system may include an extended die land to provide sufficient back pressure for a uniform melt as well as compaction and shaping of the melt.

Another example of the present invention is a cellulosic/polypropylene composite material. The composite material may be comprised of at least one cellulosic filler in an amount of about 30% to about 70% by weight, more preferably about 40% to about 50% by weight. Additionally, the composite material may be comprised of a polypropylene material in an amount of about 30% to about 70% by weight, more preferably about 50% to about 60% by weight.

The cellulosic filler(s) may be dried to a desired moisture content. For example, the cellulosic filler(s) may be dried to about 0.5% to about 3% moisture content by weight, more preferably to about 1% to about 2% moisture content by weight. However, it is appreciated that the cellulosic filler(s) may have a moisture content less than about 0.5% by weight or greater than about 3% by weight.

The polypropylene material includes at least one lubricant in an amount of about 10 to about 20 parts per 100 parts of a polypropylene resin. More preferably, the polypropylene material includes at least one lubricant in an amount of about 14 to about 19 parts per 100 parts of the polypropylene resin. The polypropylene material may also include at least one inorganic filler in an amount up to about 70 parts, more preferably between about 20 and 60 parts, per 100 parts of the polypropylene resin.

Optionally, the polypropylene material may be mixed together in a mixer such as any of those described above. After the cellulosic filler(s) are dried to a desired level, the cellulosic filler(s) and the polypropylene material may be mixed together using a mixer such as the above-described low or high intensity mixers. The composite material may then be processed by extrusion, compression molding, or any other similar, suitable, or conventional processing technique. The extrusion system may include any of the optional or preferred features of the above-described embodiment of the present invention.

EXAMPLES

A cellulosic/PVC composite was made which comprised about 111 parts of a cellulosic filler and about 112 parts of a PVC material. The PVC material was comprised of about 100 parts of a PVC resin, about 4 parts stabilizer, about 6 parts lubricants, and about 2 parts process aids. The cellulosic filler and the PVC material were mixed together and extruded. The resultant product exhibited desired appearance, strength, durability, and weatherability.

A cellulosic/polypropylene composite was also made which comprised about 143 parts of a cellulosic filler and about 136 parts of a polypropylene material. The polypropylene material was comprised of about 100 parts polypropylene resin, about 15 parts lubricants, and about 21 parts of an inorganic filler. The composite was made by first drying the wood flour to about 2% or less moisture content. The polypropylene resin, lubricants, and inorganic filler were then added and blended for about 5 minutes. Next, the composite material was extruded to form an article having desired appearance, strength, durability, and weatherability.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A siding unit comprising:

a panel having at least three courses comprised of a cellulosic/polymer composite, said composite comprising:

(a) at least one cellulosic filler in an amount of about 30% to about 60% by weight of said composite; and (b) at least one polyvinyl chloride material in an amount of about 40% to about 70% by weight of said composite, said at least one polyvinyl chloride material comprised of at least one stabilizer in an amount of about 1 to about 10 parts per 100 parts of a polyvinyl chloride resin, at least one lubricant in an amount of about 2 to about 12 parts per 100 parts of said polyvinyl chloride resin, at least one process aid in an amount of about 0.5 to about 8 parts per 100 parts of said polyvinyl chloride resin, and at least one inorganic filler in an amount up to about 10 parts per 100 parts of said polyvinyl chloride resin.

2. The siding unit of claim 1 wherein said at least one cellulosic filler is in an amount of about 40% to about 50% by weight of said composite.

3. The siding unit of claim 2 wherein said at least one cellulosic filler is in an amount of about 48% to about 50% by weight of said composite.

4. The siding unit of claim 1 wherein said at least one cellulosic filler is wood flour.

5. The siding unit of claim 1 wherein said at least one polyvinyl chloride material is in an amount of about 50% to about 60% by weight of said composite.

6. The siding unit of claim 5 wherein said at least one polyvinyl chloride material is in an amount of about 50% to about 52% by weight of said composite.

7. The siding unit of claim 1 wherein said at least one stabilizer is in an amount of about 3 to about 5 parts per 100 parts of said polyvinyl chloride resin.

8. The siding unit of claim 1 wherein said at least one lubricant is in an amount of about 4 to about 8 parts per 100 parts of said polyvinyl chloride resin.

9. The siding unit of claim 1 wherein said at least one process aid is in an amount of about 1 to about 3 parts per 100 parts of said polyvinyl chloride resin.

10. The siding unit of claim 1 wherein:

said at least one cellulosic filler is in an amount of about 40% to about 50% by weight of said composite; and said at least one polyvinyl chloride material is in an amount of about 50% to about 60% by weight of said composite, said at least one polyvinyl chloride material being comprised of said at least one stabilizer in an amount of about 3 to about 5 parts per 100 parts of said polyvinyl chloride resin, said at least one lubricant in an amount of about 4 to about 8 parts per 100 parts of said polyvinyl chloride resin, and said at least one process aid in an amount of about 1 to about 3 parts per 100 parts of said polyvinyl chloride resin.

11. A siding unit comprising:

a panel having at least three courses comprised of a cellulosic/polymer composite, said composite comprising:

(a) at least one cellulosic filler in an amount of about 30% to about 70% by weight of said composite; and (b) at least one polypropylene material in an amount of about 30% to about 70% by weight of said composite, said at least one polypropylene material comprised of at least one lubricant in an amount of about 10 to about 20 parts per 100 parts of a polypropylene resin and at least one inorganic filler in an amount up to about 70 parts per 100 parts of said polypropylene resin.

12. The siding unit of claim 11 wherein said at least one cellulosic filler is in an amount of about 40% to about 50% by weight of said composite.

13. The siding unit of 11 wherein said at least one cellulosic filler is wood flour.

14. The siding unit of claim 11 wherein said at least one polypropylene material is in an amount of about 50% to about 60% by weight of said composite.

15. The siding unit of claim 11 wherein said at least one lubricant is in an amount of about 14 to about 19 parts per 100 parts of said polypropylene resin.

16. The siding unit of claim 11 wherein said at least one inorganic filler is in an amount of about 20 to about 60 parts per 100 parts of said polypropylene resin.

17. The siding unit of claim 1 further comprising a foam backer secured to said panel.

18. The siding unit of claim 10 wherein:

said at least one cellulosic filler is in an amount of about 48% to about 50% by weight of said composite; and said at least one polyvinyl chloride material is in an amount of about 50% to about 52% by weight of said composite.

19. The siding unit of claim 11 further comprising a foam backer secured to said panel.

20. The siding unit of claim 11 wherein:

said at least one cellulosic filler is in an amount of about 40% to about 50% by weight of said composite; and said at least one polypropylene material is in an amount of about 50% to about 60% by weight of said composite, said at least one polypropylene material being comprised of said at least one lubricant in an amount of about 14 to about 19 parts per 100 parts of said polypropylene resin and said at least one inorganic filler in an amount of about 20 to about 60 parts per 100 parts of said polypropylene resin.

21. The siding unit of claim 1 wherein:

said panel has a portion that folds over to form a tongue, said tongue adapted to fit in a groove of an adjacent, substantially similar siding unit;

wherein said tongue is comprised of said composite.

22. The siding unit of claim 1 wherein:

said panel has a bottom portion that forms a groove that opens toward a top portion of said panel, said groove adapted to receive a tongue of an adjacent, substantially similar siding unit;

wherein said groove is comprised of said composite.

23. The siding unit of claim 1 wherein:

said panel has a top portion that folds over to form a tongue and a bottom portion that forms a groove that opens toward said top portion such that said tongue is adapted to fit in said groove of an adjacent, substantially similar siding unit;

wherein said tongue and said groove are comprised of said composite.

24. The siding unit of claim 11 wherein:

said panel has a portion that folds over to form a tongue, said tongue adapted to fit in a groove of an adjacent, substantially similar siding unit;

wherein said tongue is comprised of said composite.

25. The siding unit of claim 11 wherein:

said panel has a bottom portion that forms a groove that opens toward a top portion of said panel, said groove adapted to receive a tongue of an adjacent, substantially similar siding unit;

wherein said groove is comprised of said composite.

26. The siding unit of claim 11 wherein:

said panel has a top portion that folds over to form a tongue and a bottom portion that forms a groove that opens toward said top portion such that said tongue is adapted to fit in said groove of an adjacent, substantially similar siding unit;

wherein said tongue and said groove are comprised of said composite.

* * * * *